US012012675B2

(12) United States Patent
Aceves Tinajero et al.

(10) Patent No.: US 12,012,675 B2
(45) Date of Patent: Jun. 18, 2024

(54) KNITTED COMPONENT COMPRISING A WINDOW

(71) Applicant: NIKE, Inc., Beaverton, OR (US)

(72) Inventors: Juan L. Aceves Tinajero, Beaverton, OR (US); Nicolino Matteo, Hillsboro, OR (US); Ashleigh S. Line, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 301 days.

(21) Appl. No.: 16/659,959

(22) Filed: Oct. 22, 2019

(65) Prior Publication Data

US 2020/0131677 A1 Apr. 30, 2020

Related U.S. Application Data

(60) Provisional application No. 62/751,010, filed on Oct. 26, 2018.

(51) Int. Cl.

| | |
|---|---|
| ***D04B 1/10*** | (2006.01) |
| ***A43B 23/02*** | (2006.01) |
| ***D04B 1/12*** | (2006.01) |
| ***D04B 21/08*** | (2006.01) |

(52) U.S. Cl.

CPC ..... *D04B 1/102* (2013.01); *A43B 23/0215* (2013.01); *D04B 1/12* (2013.01); *D04B 21/08* (2013.01)

(58) Field of Classification Search

CPC .... D04B 21/08; D04B 1/12; D04B 2501/043; A43B 1/04

See application file for complete search history.

(56) References Cited

U.S. PATENT DOCUMENTS

| | | | | |
|---|---|---|---|---|
| 2004/0118018 | A1* | 6/2004 | Dua | A43B 1/14 36/3 A |
| 2015/0216253 | A1* | 8/2015 | Podhajny | A43B 1/04 28/165 |
| 2017/0224044 | A1* | 8/2017 | Dua | D04B 1/16 |
| 2017/0245581 | A1* | 8/2017 | McFarland, II | D04B 1/24 |

FOREIGN PATENT DOCUMENTS

| | | | |
|---|---|---|---|
| CN | 104106883 | A | 10/2014 |
| CN | 106028861 | A | 10/2016 |
| CN | 108056532 | A | 5/2018 |
| WO | WO 2013/151978 | A1 | 10/2013 |
| WO | WO 2018/089639 | A1 | 5/2018 |

OTHER PUBLICATIONS

International Preliminary Report on Patentability received for PCT Patent Application No. PCT/US2019/057376, dated May 6, 2021, 10 pages.

International Search Report and Written Opinion for corresponding PCT/US2019/057376, dated Feb. 18, 2020, 16 pages.

* cited by examiner

*Primary Examiner* — Jenna N Chandhok

(74) *Attorney, Agent, or Firm* — Shook, Hardy & Bacon L.L.P.

(57) ABSTRACT

The present disclosure provides a knitted component having a first yarn and a second yarn, where the first yarn comprises a thermoplastic material having a melting temperature. The knitted component includes window regions substantially or exclusively formed of the first yarn, such that melting the first yarn in these window regions form at least a semi-transparent window allowing a viewer to see through the knitted component.

11 Claims, 8 Drawing Sheets

KNITTED COMPONENT COMPRISING A WINDOW

CROSS-REFERENCE TO RELATED APPLICATION

This application claims the benefit of priority under 35 U.S.C. § 119(e) to U.S. Provisional Application Ser. No. 62/751,010, filed in the U.S. Patent and Trademark Office on Oct. 26, 2018, which is incorporated by reference in its entirety herein.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot. The upper may also extend underfoot. Access to the void on the interior of the upper is generally provided by an ankle opening in a heel region of the footwear. A lacing system or other adjustment or closure system is often incorporated into the upper to adjust the fit of the upper, and/or facilitating entry and removal of the foot from the void within the upper. In addition, the upper may include a tongue that extends under the lacing system to enhance adjustability of the footwear, and the upper may incorporate other structures or elements, such as a heel counter for example, to limit movement of the heel.

DETAILED DESCRIPTION

Figure 1:
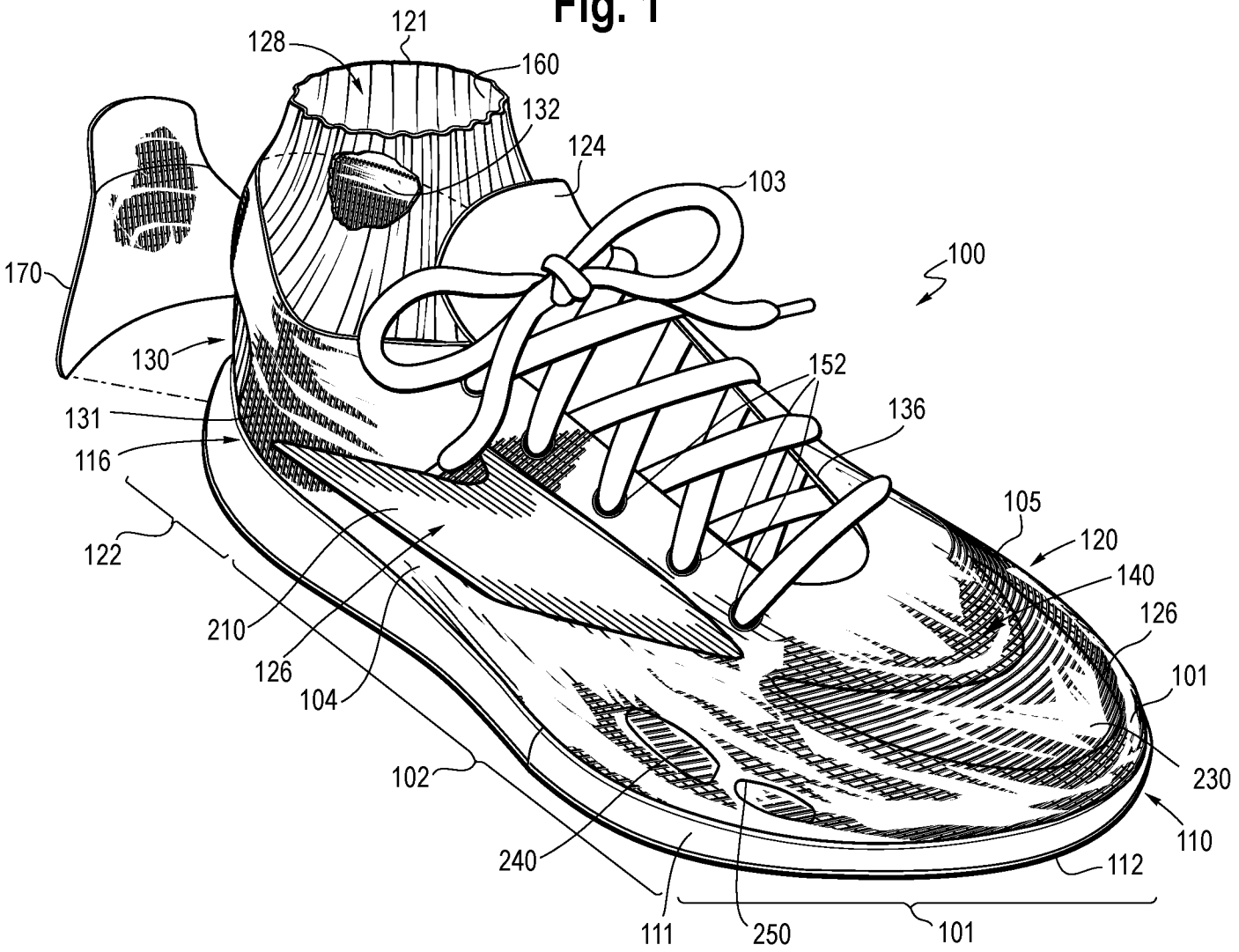
FIG. 1 shows a perspective view of an example of an article of footwear in accordance with certain embodiments of this disclosure.

Various aspects are described below with reference to the drawings in which like elements generally are identified by like numerals. The relationship and functioning of the various elements may better be understood by reference to the following description. However, aspects are not limited to those illustrated in the drawings or explicitly described below. It also should be understood that the drawings are not necessarily to scale, and in certain instances, details may have been omitted that are not necessary for an understanding of aspects disclosed herein.

Certain aspects of the present disclosure relate to uppers configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

According to an embodiment, a knitted component is disclosed comprising a first yarn comprising a thermoplastic material having a first melting temperature, and a second yarn having a second melting temperature higher than the first melting temperature. The knitted component may further comprise a first region comprising the first yarn and the second yarn, wherein the first region comprises a greater percentage by unit area of the second yarn than the first yarn, and a window region exclusively formed of the first yarn, wherein the first region at least partially surrounds the window region. The knitted component may further comprise a transition region located between the first region and the window region, and wherein in the transition region, the second yarn from the first region extends to the window region and terminates at the window region.

According to another embodiment, a textile is disclosed comprising a first yarn comprising a thermoplastic material having a first melting temperature, and a second yarn having a second melting temperature higher than the first melting temperature. The textile may further comprise a first region comprising the first yarn and the second yarn, wherein the first yarn is at least partially fused to one or more knit loops of the second yarn. The textile may further comprise a first fused area formed exclusively of the first yarn, wherein the first fused area forms a translucent or at least a semi-transparent window and wherein one or more knit loops of the first yarn that form the first fused area are substantially indistinguishable, wherein the first region at least partially surrounds the first fused area. The textile may further comprise a transition region formed of the first yarn and the second yarn, the transition region being located between the first region and the first fused area, wherein the second yarn from the first region extends to the first fused area through the transition region, and wherein, in the transition region, the first yarn forms a second fused area where one or more knit loops of the first yarn that form the second fused area are substantially indistinguishable and wherein the knit loops of the second yarn substantially maintain their knit loop structure.

According to another embodiment, a method of forming a textile is disclosed. The method may comprise knitting a first region comprising a first yarn and a second yarn, wherein the first yarn comprises a thermoplastic material having a first melting temperature and the second yarn has a second melting temperature higher than the first melting temperature and wherein the first region comprises a greater percentage by unit area of the second yarn than the first yarn. The method may further comprise knitting a window region exclusively formed of the first yarn and wherein the first region at least partially surrounds the window region, and knitting a transition region located between the first region and the window region, wherein in the transition region, the second yarn from the first region extends to the window region and terminates at the window region. The method may further comprise heating the textile to at least the first melting temperature to at least partially melt the first yarn.

With respect to FIG. 1, an example of an article of footwear 100 is generally depicted as including a sole structure 110 and an upper 120. The upper 120 may include a lateral side 104, a medial side 105, a heel region 122, a mid-foot region 102, and a forefoot region 101. The upper 120 may incorporate a knitted component 140 to form at least a portion of an interior void 128 for securely and comfortably receiving a foot. The area of the shoe where the sole 110 joins the outer edge of the upper 120 may be referred to as the biteline 116. The upper 120 may be joined to the sole 110 in a fixed manner using any suitable technique, such as through the use of an adhesive, bonding, sewing, etc.

The knitted component 140 may be formed as an integral one-piece element from a single knitting process, such as a weft knitting process (e.g., with a flat knitting machine with one, two, or more needle beds, or with a circular knitting machine), a warp knitting process, or any other suitable knitting process. As such, the upper 120 may be formed from the knitted component 140 without the need for significant post-knitting processes or steps. Alternatively, two or more portions of the knitted component 140 may be formed separately as distinct integral one-piece elements, and then the respective elements may be attached. In one example, the upper may be formed of a forefoot portion and a heel portion that are attached together at one or more seams. As used in this application, a yarn used to form the knitted component 140 may include a strand, such as a monofilament strand, and is not intended to limit the present disclosure to multifilament yarns or materials.

In some embodiments, the sole structure 110 may include a midsole 111 and an outsole 112. The article of footwear may additionally include a throat 136 and an ankle opening 121, which may be surrounded by a collar (not shown) according to some embodiments. The throat 136 may generally be disposed in the mid-foot region 102 of the upper 120. The mid-foot region 102 is depicted as a section of the upper 120 located between the heel region 122 and a toe region 101.

The upper 120 may define a void 128 in the article of footwear that is configured to receive and accommodate the foot of a user or wearer. As shown in FIG. 1, some embodiments of the article of footwear may include an inner bootie sock 160 positioned within the void 128. The bootie sock 160 may be detached from the rest of the article of footwear 100, or it may be attached to a portion of the article of footwear 100 within the void 128. For example, the bootie sock 160 may be secured to a portion of the sole 110 exposed within the void 128 via adhesive or stitching. The bootie sock 160 may be made from a breathable material such as cotton (or cotton blend), neoprene, polymer-based material, or other breathable material having a high degree of elasticity. The bootie sock 160 may be formed into a mesh inner lining that wraps around the heel region 122 within the void 128. When a wearer's foot is inserted into the void, the bootie sock 160 may surround, envelop or enclose a wearer's entire foot or a portion of a wearer's foot.

As shown, the upper 120 may also include a heel component 170 that is separately constructed from the knitted component 140 that forms at least a portion of the upper 120. According to some embodiments, the heel component 170 may include the portion of the bootie sock 160 that is located in the heel region 122 of the upper 120. The heel component 170 may be knit from one or more yarns or, in other embodiments, the heel component 170 may be formed of additional or alternative natural or synthetic materials including leathers, plastics, rubbers and/or other textiles and combinations thereof. FIG. 1 illustrates one embodiment of an article of footwear 100 without the heel component 170. In this embodiment, the upper 120 comprises a heel opening 130 formed within the upper 120 where an inside of the article of footwear 100 may be seen (e.g., the bootie sock 160 may be shown through the heel opening 130).

In FIG. 1, a tongue 124 is disposed in the throat 136 of the article of footwear 100, but the tongue 124 is an optional component, as is the lace 103. Although the tongue 124 depicted in FIG. 1 is a traditional tongue, the tongue 124, if included, may be any type of tongue, such as a gusseted tongue or a burrito tongue. If a tongue is not included, the lateral and medial sides of the throat 136 may be joined together, for example. When lace 103 are used, the throat 136 includes a number of holes 152 for receiving the lace 103.

As described in further detail below, the upper 120 may have one or more fused area(s) 126 that are formed where a heating process has been applied to the upper 120. In this description, the term "fused area" generally means an area of the upper 120 where distinct portions of material forming the upper (e.g., distinct individual strands or yarns of a knitted component) are partially or substantially bonded together and/or form a continuous material. A "fused area" is not required to be formed by any specific process. In a non-limiting example, two or more separate yarns, including monofilament and/or multifilament yarn, may form a fused area when at least a portion of the separate yarns are bonded such that at least a portion of the separate yarns become continuous with one another. Further, after bonding to form a fused area, the material of the once-separate yarns may become at least partially and/or substantially visually or physically indistinguishable, or both. Visually, the melted yarns in the fused area may be at least partially and/or substantially visually indistinguishable from a distance of about several inches to several feet away to a person having standard or normal vision. However, it is appreciated that a person with better vision may be able to distinguish certain properties of the fused areas (e.g., such as the once-separate yarns having become at least partially and/or substantially visually or physically indistinguishable, or both after melting as well as the texture of the surface in the fused area) from these same distances or even further distances. The heating process may include one or more methods or procedures, such as, for example, securing the upper to a jig and then exposing the upper to heat such as steam, and/or exposing the upper to heat when pressed between plates having a pre-selected temperature, pressure and time.

The fused area 126 may have any suitable size, configuration and/or shape, and the upper 120 may have multiple fused areas 126 located in various locations throughout the upper 120. The fused area 126 may be formed in any portion of the upper 120 where a meltable yarn is present and a heating process has been applied for melting the meltable yarn. The fused area(s) 126 may define a portion of a first surface 131 of the upper 120, which may be an outer surface. In addition or alternatively, the fused area(s) 126 may also define a portion of a second surface 132 of the upper 120. As depicted, the second surface 132 of the upper 120 may be an inner surface at least partially defining the void 128 of the article of footwear 100. As described in more detail below, the fused area 126 may exhibit certain advantageous properties including a relatively high degree of rigidity, strength, water resistance, and the ability of thermal bonding, for example. The fused area(s) 126 may also provide advantageous visual and aesthetic properties.

In some embodiments, thermoplastic polymer materials used to form the first yarn 201 may provide the ability to heat and then cool a portion of the first yarn 201 to thereby form an area of bonded or continuous material (a "fused area") that has the ability of thermal bonding, for example. As utilized herein, the term "thermal bonding" or variants thereof is defined as a securing technique between two elements that involves a softening or melting of a thermoplastic polymer material within at least one of the elements such that the materials of the elements are secured to each other (e.g. the bond, link, or structure that joins two elements) when cooled. Additionally, thermal bonding does not generally involve the use of stitching or adhesives, but involves directly bonding elements to each other with heat. In some situations, however, stitching or adhesives may be utilized to supplement the thermal bond or the joining of elements through thermal bonding. A needle punching process may also be utilized to join the elements or supplement the thermal bond.

In some embodiments, the fused area may be entirely formed by the first yarn 201 such that upon heating, the first yarn is melted to form one or more continuous window regions 210 that are translucent or at least semi-transparent as described in further detail herein. According to this disclosure, it is understood that semi-transparent may include a translucent and/or a transparent characteristic within the window regions 210. A transparent characteristic is defined as allowing light to pass through the window regions 210, and having objects behind the window regions 210 be distinctly seen through the window regions 210. A translucent characteristic is defined as allowing light to pass through the window regions 210 without necessarily allowing for detailed images behind the window regions 210 to be seen through the window regions 210. In other embodiments, this process of thermal bonding may involve the melting or softening of the first yarn 201 of the knitted component such that the thermoplastic polymer materials included in the first yarn 201 intermingle with materials of other elements (e.g., the second yarn 202), thereby securing the first yarn 201 and the second yarn 202 together when cooled. For example, the melting or softening of the first yarn 201 causes the first yarn 201 to extend into or infiltrate the knit structure formed by the second yarn 202 to at least partially secure the respective first and second yarns 201, 202 together when cooled.

Figure 2:
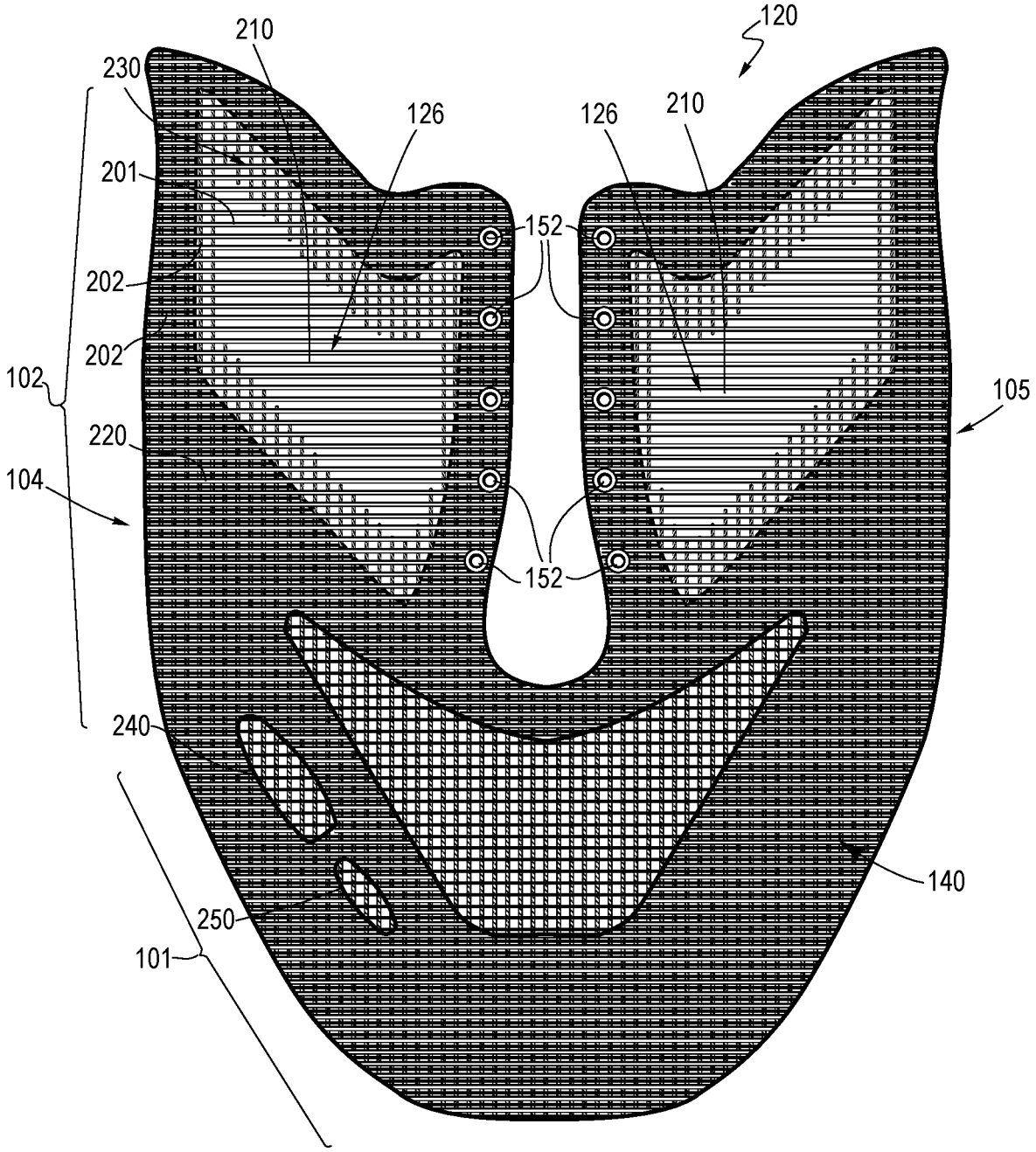
FIG. 2 shows a top view of one example of a knitted component for an article of footwear prior to a heating process in accordance with certain embodiments of this disclosure.

As mentioned above, the upper 120 may be a one-piece upper or it may be formed from two pieces, or more than two pieces, that are attached together at one or more seams to form the upper 120. Referring to FIG. 1, the upper 120 is shown to be formed of two pieces, including the heel component 170 and the knitted component 140. Referring to FIG. 2, the knitted component 140 (shown in a flat, two-dimensional pre-assembled state, separate from other elements of the article of footwear of FIG. 1) may be formed at least partially from a knit textile constructed of a plurality of knit loops that make up one or more knit courses, or it may be substantially or entirely formed of a knit textile. As depicted in FIG. 2, at least the forefoot region 101 and midfoot region 102 of the upper 120 may be substantially or entirely formed of the knitted component 140. It is also contemplated that, in some embodiments, at least a portion of the heel component 170 may also be formed of the knitted component 140. The heel component 170 may also be formed of a knitted component 140 or it may be formed of other knit or non-knit textiles and materials, or combinations thereof, as described herein.

For example, while the upper 120 is described herein as including the knitted component 140, it alternatively or additionally could include a textile component formed by a process other than knitting (e.g., weaving) and may also include other materials including but not limited to leather, plastics, rubbers, and any other materials suitable for incorporation into the upper of an article of footwear. The knitted component 140 may be a single layer knitted component or it may be a multi-layer knitted component. In the disclosed embodiments, the knitted component 140 is described as a single-layer knitted component knitted from at least two different types of yarn, where the knitted component 140 includes the first surface 131 (e.g., outer surface) and the second surface 132 (e.g., inner surface) as described in further detail below.

As shown in exemplary FIG. 2, a first yarn 201 may form at least a portion of the first (outer) surface 131 of the knitted component 140 and may form at least a portion of the second (inner) surface 132. In this description, the first yarn 201 may include a yarn (or multiple yarns) that includes or incorporates a thermoplastic polymer material configured to form the fused area 126. Illustrative, non-limiting examples of thermoplastic polymers include polyurethanes, polyamides, polyolefins, nylons, and resins. In contrast to thermoset polymeric materials (described below), thermoplastic polymers melt when heated to a certain temperature and return to a solid state when cooled below a certain temperature. More particularly, a thermoplastic polymer transitions from a solid state to a softened or liquid state when subjected to temperatures at or above its melting point, and then the thermoplastic polymer transitions from the softened or liquid state to a solid state when sufficiently cooled below its melting point. As such, thermoplastic polymer materials may be melted, molded, cooled, re-melted, re-molded, and cooled again through multiple cycles. As a particular characteristic of an embodiment of the first yarn 201, the first yarn 201 may be visually opaque and/or solid in color (e.g., an opaque white color yarn) prior to melting, and translucent, or at least semi-transparent, following a heating process. In other words, the first yarn 201 may appear to be one color (and generally opaque) prior to heating, and after a heating process, the first yarn 201 within a fused area(s) 126 will be visually translucent, or at least semi-transparent.

Any portion of the first yarn 201 may have one or more thermoplastic polymers (collectively "the thermoplastic polymer material"), and in some embodiments, substantially the entirety of the first yarn 201 may be formed of the thermoplastic polymer material. In one non-limiting example, the first yarn 201 may be a yarn comprised of a poly block amide resin and have a linear mass density of about 750 denier. In one example, the resin used to form the first yarn 201 may be provided by Lubrizol Corporation and the resin may then be extruded and spun by Premiere Fibers LLC of Ansonville, N.C. The first yarn 201 may, in one non-limiting example, be formed of a nylon-based thermoplastic elastomer known under the tradename of PEBAX®. The first yarn may sometimes be referred to herein as "N110." The thermoplastic polymer material of the first yarn 201 may have a melting temperature less than the melting temperature, or decomposition temperature, of a second yarn 202 included in the knitted component 140. Preferably, the first yarn 201 is solid yarn. However, it is also contemplated that the first yarn 201 may have a core and sheath configuration, where the core and sheath may have different melting temperatures. For example, the sheath of a core-sheath yarn may have a lower melting temperature than the core or vice versa.

The melting temperature of the thermoplastic polymer material of the first yarn 201 may have a melting temperature of less than 200° C., and according to some embodiments the melting temperature of the first yarn 201 may preferably be between 100° C. and 150° C., and in some embodiments, approximately 130° C. The melting temperature of the first yarn 201 may be approximately 100° C. less than the melting temperature of the second yarn 202 in some embodiments, though any other suitable difference in melting temperatures is contemplated. The higher melting temperature of the second yarn 202, when compared to the relative lower melting temperature of the first yarn 201, allows for a heating process to be applied to the upper 120 (or portions thereof) where the first yarn 201 is melted without melting the second yarn 202.

The knitted component 140 may also include one or more yarns formed of material(s) other than the specific thermoplastic polymer material described above. As shown in exemplary FIG. 2, a second yarn 202 may form at least a portion of the first (outer) surface 131 of the knitted component 140 and may form at least a portion of the second (inner) surface 132. In one example, the second yarn 202 may be formed from a different material composition from the first yarn 201. The second yarn 202 may be substantially formed of a material that has a melting point (if it is a thermoplastic polymer material) or a decomposition temperature (if it is a thermoset material) that is higher than the melting point of the first yarn 201. Illustrative, non-limiting examples of types of yarns that may form the second yarn 202 include yarns comprising thermoplastic materials, or, alternatively, thermoset polymeric materials and natural fibers, such as cotton, silk, and wool, or materials with a relatively high melting or decomposition point. In some embodiments, the melting point or decomposition temperature of the second yarn 202 is greater than about 140° C. based on atmospheric pressure at sea level. The second yarn 202 is formed of a material with a melting point higher than that of the first yarn 201, and references to the first yarn as being formed of a thermoplastic polymer material herein do not limit the second yarn from being a separate thermoplastic polymer with a higher melting point as well as having different yarn characteristics and properties, for example.

In one non-limiting example, the second yarn 202 may comprise one or more yarns with one or multiple properties including yarn(s) with different elasticity, breathability, denier, color, and/or durability characteristics or different visual characteristics, or a combination thereof, for example. According to some embodiments, the second yarn 202 is a polyester yarn, sometimes referred to herein as "P21." The second yarn 202 ("P21" yarn) may be formed of four strands or ends of another polyester yarn (sometimes referred to herein as "P16" yarn). In one example, the four strands of polyester "P16" yarn may be air tacked, braided, twisted or otherwise comingled or combined together to form the "P21" or second yarn 202. The second yarn 202 ("P21" yarn) may have an approximate denier range of about 650 D to about 750 D, a tensile strength of about 2.39 to about 2.6 kgf and an elongation of about 29% to about 37% and a melting point in the range of about 240 to about 260° C.

The knitted component 140 is formed from the first yarn 201 and the second yarn 202 during a knitting or other textile manufacturing process. In one example, the knitted component 140 is formed during a single knitting process (e.g., simultaneously on a knitting machine). For example, the knitted component 140 may be formed on a flat knitting machine with two needle beds (e.g., front needle bed and a back needle bed). The first yarn 201 and the second yarn 202 may be used to form the knitted component 140 using different needles on the front needle bed and the back needle bed. For example, when a yarn is knit on the front needle bed, that yarn may be present and/or visible on a first surface of the knitted component 140. Likewise, when a yarn is knit on the back needle bed, that yarn may be present and/or visible on a second surface that is opposite the first surface. Thus, during the knitting process, knitting a particular yarn on one needle bed or the other needle bed (or by alternating between the needle beds) may allow a particular yarn to be brought to one surface or the other surface of the knitted component 140 to control structural and/or visual or aesthetic characteristics of different areas or regions of the knitted component 140, for example. One or more different stich combinations and/or knitting techniques may also serve to control and vary the characteristics of the knitted component 140 such as density and thickness.

Figure 4:
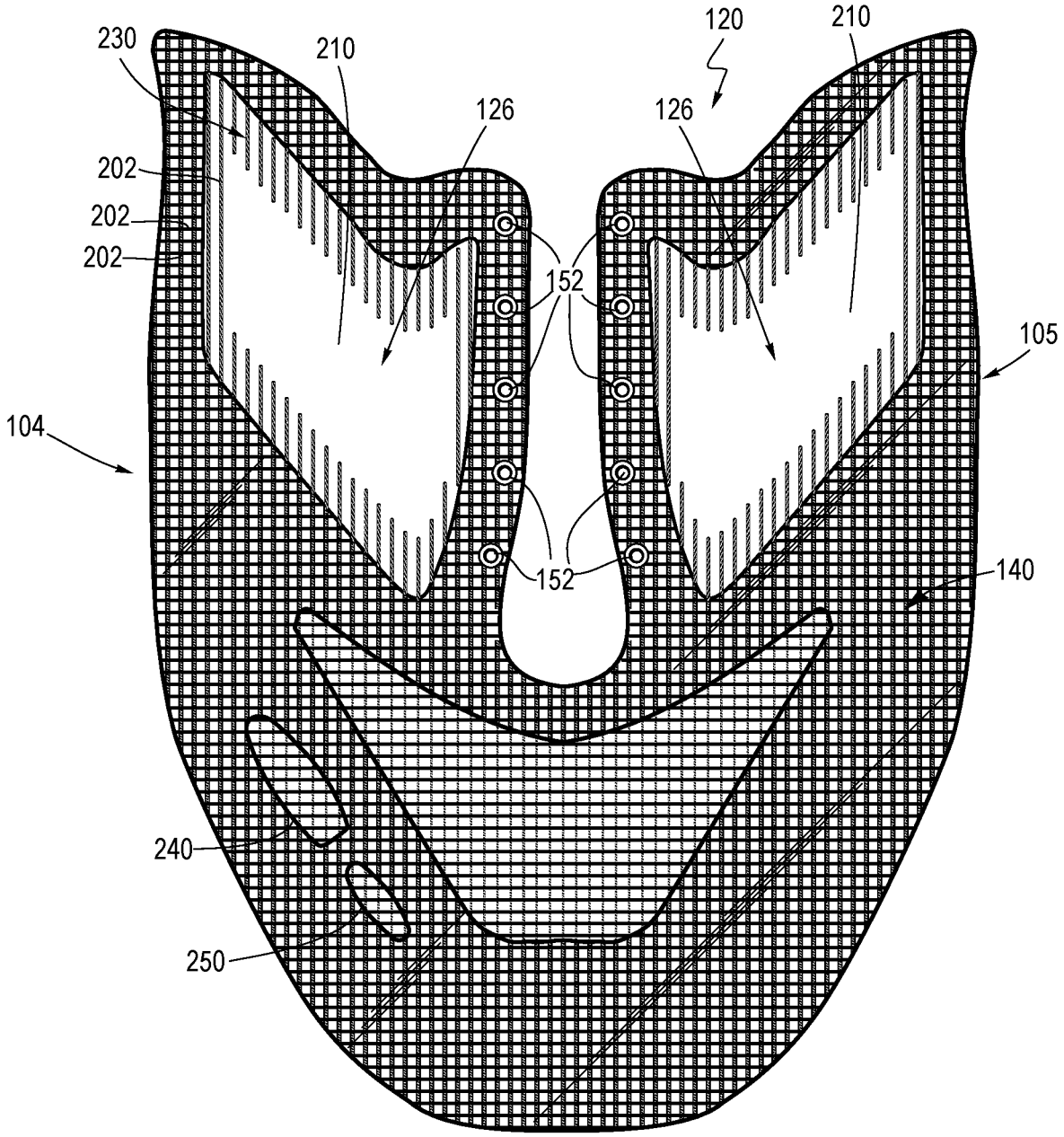
FIG. 4 shows a top view of one example of a knitted component for an article of footwear after a heating process in accordance with certain embodiments of this disclosure.

As mentioned above, a fused area 126 may be formed at any location of the upper 120 where the first yarn 201 is present and the upper 120 is exposed to a heating process to at least partially melt the first yarn 201. As shown in FIG. 2 and FIG. 4, the knitted component 140 comprises at least two relatively large fused areas 126, although more or fewer fused areas of various shapes, sizes and configurations may be present as necessary or desired. The at least two fused areas 126 include window regions 210. In one exemplary embodiment as shown, one window region 210 may be generally located on a medial side 105 of the upper 120 while another window region 210 may be generally located on a lateral side 104 of the upper 120. The number and placement of the window region(s) 210 may be varied as necessary or desired and/or to achieve a certain visual or structural effect, for example. The window regions 210 may be formed exclusively of the first yarn 201. That is, in one example, the window region 210 is knit only of first yarn 201 (the "N110" yarn) and the second yarn 202 is not present in the window region 210. However, it is also contemplated that the second yarn 202 may, in some embodiments, be present in combination with the first yarn 201 in the window region 210.

Figure 3:
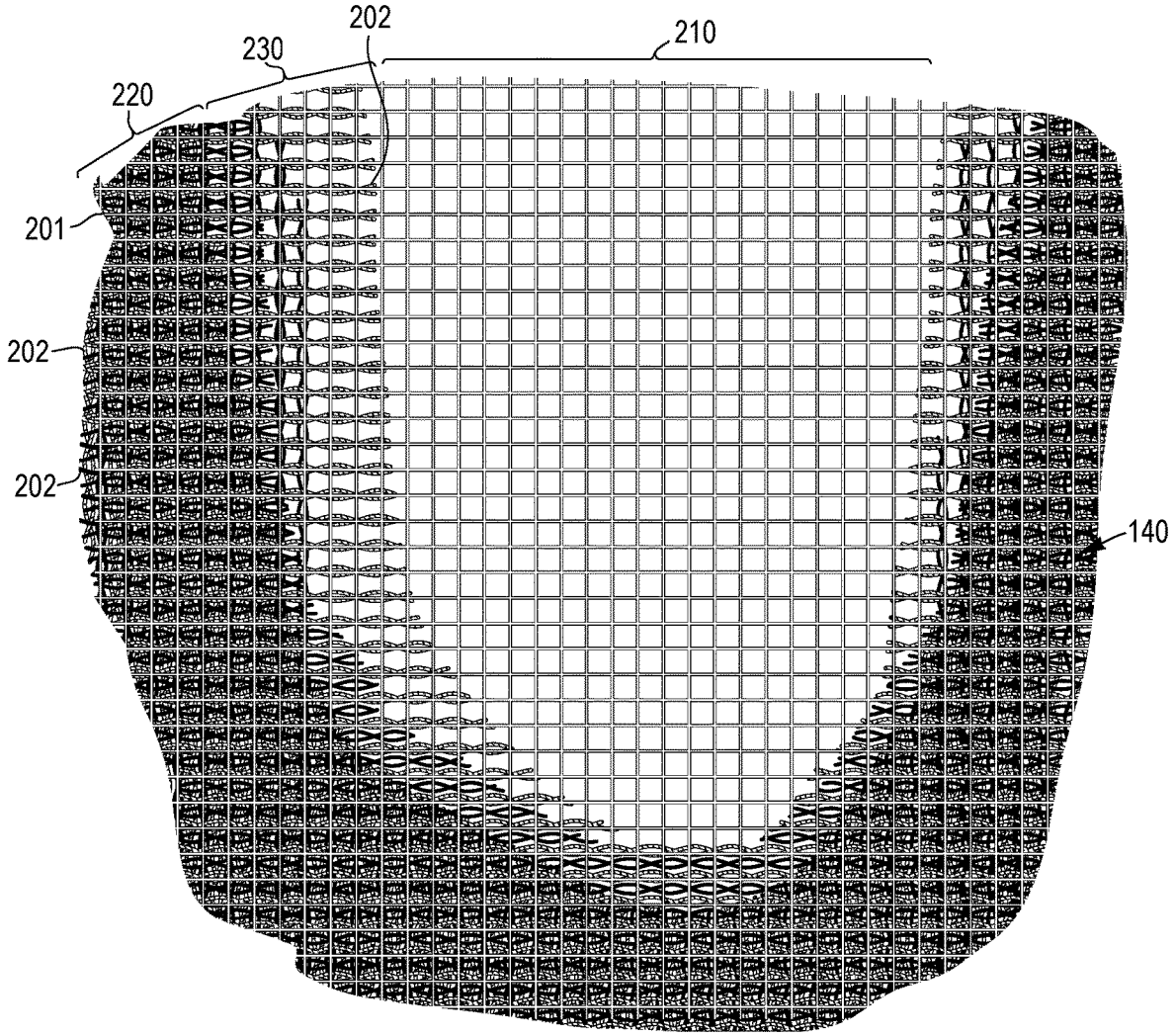
FIG. 3 shows a magnified view of an area of the knitted component of FIG. 2 in accordance with certain embodiments of this disclosure.

FIG. 3 shows a magnified view of an area on the upper 120 that surrounds the window region 210 prior to a heat processing treatment. In a non-limiting example, each of the two window regions 210 shown in FIG. 2 are knit from the first yarn 201 and are encircled or at least partially bounded by a transition region 230 which essentially serves as a border or periphery around each of the window regions 210. The transition region 230 is formed from a combination of the first yarn 201 and the second yarn 202. The remaining portion of the knitted component 140 that generally surrounds the transition region 230 may be referred to as surrounding region 220. The surrounding region 220 is formed from a combination of the first yarn 201 and the second yarn 202. As such, the transition region 230 is located (e.g. sandwiched) between at least a portion of the window region 210 and at least a portion of the surrounding region 220. As mentioned above, both the surrounding region 220 and the transition region 230 are formed of a combination of the first yarn 201 and the second yarn 202. In one example, the second yarn ("P21") 202 is present in a generally higher percentage by unit area than the first yarn 201 ("N110") in the surrounding region 220. In other words, the surrounding region 220 comprises more (a greater percentage) of the second yarn 202 than the first yarn 201 when compared to the transition region 230 or the window region 210. In contrast, the first yarn 201 (the "N110") is present in a generally higher percentage by unit area than the second yarn 202 (the "P21") in the transition region 230. In other words, in one embodiment, the transition region 230 comprises more (a greater percentage) of the first yarn 201 (the N110) than the second yarn 202 when compared to the surrounding region 220. Although, it is also contemplated that the first yarn 201 and the second yarn 202 can be present in generally equal percentages in the surrounding region 220 and/or the transition region 230 or in any other suitable percentages or proportions as necessary or desired.

In one embodiment, surrounding area 220 comprises approximately 50% per square inch of the first yarn 201 and approximately 50% per square inch of the second yarn 202, while the transition region 230 comprises approximately 75% per square inch of the first yarn 201 and approximately 25% per square inch of the second yarn 202. The window region 210 comprises approximately 100% of the first yarn 201. In other embodiments, the window region 210 may include some amount (e.g. a relatively small percentage of the second yarn 202) combined with the first yarn 201.

FIG. 3 shows a magnified view of a portion of the knitted component 140 prior to a heating process, including the window region 210 formed exclusively from the first yarn 201, the surrounding region 220 formed of a combination of the first yarn 201 and the second yarn 202, and the transition region 230 located between the window region 110 and the surrounding region 220 formed of a combination of the first yarn 201 and the second yarn 202. Thus, in the transition region 230, one or more courses of the second yarn 202 extend from the surrounding region 220 in a direction generally towards the window region 210 and terminate before reaching the window region 210 or terminate at the window region 210.

One or more courses of the first yarn 201 may lie adjacent to and/or generally surround the one or more courses of the second yarn 202 in the transition region 230 and in the surrounding region 220. Following a heat processing treatment, the first yarn 201 may transition from a generally solid state to a melted and/or liquid state as it melts to form a fused area 126. As such, the first yarn 201 in the fused area(s) 126 corresponding to the window region 210 transitions from a generally opaque knit structure to a translucent or at least semi-transparent window. In contrast, the second yarn 202 does not melt during the heat processing treatment, as the temperature of the heat is less than the melting temperature of the second yarn 202. As such, the second yarn 202 generally retains its knit structure. The resulting visual effect may be that the plurality of knit loops that form the one or more knit courses of the second yarn 202 appear to be floating within a translucent or at least semi-transparent fused area 126 (window) formed by the first yarn 201 within the transition region (e.g., knit loops of the second yarn 202 appear to be floating in the fused area(s) 126 formed by the melted first yarn 201 within the transition region 230). This second yarn 202 may therefore be compared to a reinforcing bar or "rebar" within the surrounding "concrete" formed by the fused first yarn 201 within the transition region 230. The knit structure across the window region 210, the surrounding region 220, and the transition region 230 may be such that a thickness of the knitted component across these regions may be relatively smooth, uniform and/or even. This may be achieved by controlling the density of yarns, by using different knitting techniques, and/or knit structures.

Figure 5:
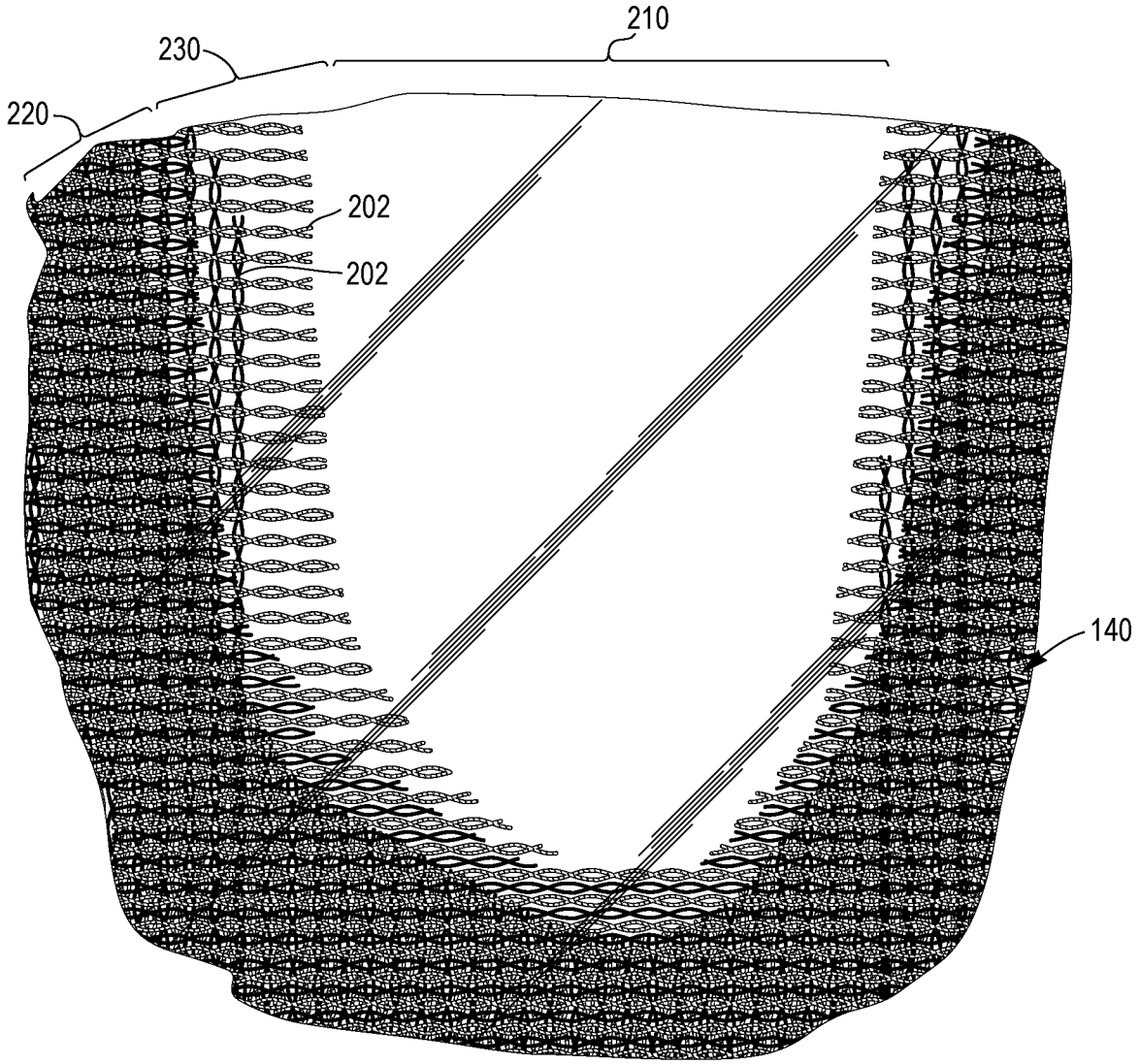
FIG. 5 shows a magnified view of the knitted component of FIG. 4 in accordance with certain embodiments of this disclosure.

So following the heating process, the generally opaque first yarn 201 shown in FIG. 2 and FIG. 3 transitions to a generally translucent or semi-transparent material state as represented by the diagonal markings in the post-heating representation of the upper 120 shown in FIGS. 4-5. In other areas of the upper 120 where the first yarn 201 is present and is melted in response to a heat processing treatment, the upper 120 may generally visually appear to have a higher relative sheen. In particular, the diagonal sheen markings are shown over the window region 210, the transition region 230, and the window region 210 to represent fused areas including at least portions of the melted first yarn 201 following the heating process.

FIG. 4 shows the upper 120 (shown separate from other elements of the article of footwear of FIG. 1) following a heating process applied to at least a portion of the knitted component 140 of the upper 120. The heating process may correspond to any one or more of the processes represented by FIGS. 7A-7D, or other suitable heat processing treatments. In addition to the at least two window regions 210 described above, any other portions of the knitted component 140 that includes the first yarn 201 may also become fused area(s) 126. For example, following a heat treatment, the first yarn 201, formed of a thermoplastic polymer, may transition from a solid state to a softened or liquid state when subjected to temperatures at or above its melting point, and then transition from the softened or liquid state to a solid state when sufficiently cooled below its melting point. Thus, upon heating to a temperature at or above its melting point, the first yarn 201 may transition to a softened or liquid state and thereby melt into, around and over one or more loops and/or courses of the surrounding and/or adjacent second yarn 202. The physical and/or visual characteristics of the second yarn 202 will not have been affected substantially, if at all, following the heating process. Rather, following the heating process the first yarn 201 will have transitioned (e.g., melted) into a translucent, or at least semi-transparent state and fused to the surrounding and/or adjacent second yarn 202 within the surrounding region 220 and transition region 230 where the first yarn 201 is present.

Thus, when subjected to a heating process, the first yarn 201 may fuse to the adjacent and surrounding second yarn 202 in any and all portions of the knitted component 140 where the first yarn 201 is present. Thus, in an embodiment where the first yarn 201 is present in all, or substantially all of the surrounding region 220 of the upper 120, fusing of the first yarn 201 to the adjacent and surrounding knit loops of the second yarn (and courses formed from the second yarn 202) will occur and would result in all, or substantially all of the surrounding region 220 becoming an additional fused area 126. It is contemplated that the first yarn 201 may be absent from one or more areas of the surrounding region 220, in which case a fused area 126 would not be formed in that particular area upon heat-treating the upper 120.

Advantageously, the thermoplastic polymer material of the first yarn 201 may form the fused area(s) 126 at certain locations during the heating process, where the heating process may be applied to either the first surface 131 or the second surface 132, or both, of the knitted component 140. In one example, areas 240, 250 are shown to represent one or more areas where the first yarn 201 may be absent or be present in a reduced percentage per unit area than the second yarn 202. Where the first yarn 201 is absent, that portion of the upper 240, 250 may lack a substantial fused area 126 and/or when the first yarn 201 is present in a reduced percentage per unit area of the upper 120, that portion 240, 250 of the upper 120 may appear to have a different visual characteristic on the visible surface of the knitted component 140. Likewise, where the first yarn 201 is knit on one of the first needle bed or the second needle bed of a knitting machine, the fused area 126 in areas 240, 250 may be visible on the reverse second inner surface 132 of the knitted component 140 where the first yarn 201 was exposed and thus melted from the heating process. The fused areas 126 may include, but are not limited to the window regions 210 as well as any portion of the upper 120 where the first yarn 201 is present, including, for example, the surrounding region 220 and/or transition region 230. As described in more detail below, the temperature at which the heating process is operated is within a range where the first yarn 201 is at least partially melted, but below the melting temperature of the second yarn 202 such that the second yarn 202 is not melted.

FIG. 5 shows a magnified view of an example of a fused area 126 on the upper 120 that forms the window region 210 following the heating process. The fused area 126 shown in FIG. 5 corresponds to the same area shown in FIG. 3 prior to the heating process. The fused area in FIG. 5 includes the window region 210 formed exclusively from the first yarn 201, where following the heating process the first yarn 201 has melted into a translucent or at least semi-transparent window 210 that allows a user to view directly through the knitted component 140 and see what is behind the knitted component 140 and/or what is within the void 128. For example, a person may be able to look through the window region 210 and view inside the article of footwear 100. When the bootie sock 160 is included in the article of footwear 100, the window region 210 allows a person to view through the knitted component 140 and view the bootie sock 160 if a bootie sock 160 is present in a location behind the window within the void 128. If a bootie sock 160 is not present, a person may be able to view at least a portion of a wearer's foot located within the void 128.

The surrounding region 220 formed of a combination of the first yarn 201 and the second yarn 202 may have a different visual characteristic following the heating process as compared to before the heating process. For example, the surrounding region 220 may, as mentioned above, have a higher shine, luster or sheen as a result of the melted first yarn 201 fusing with the second yarn 202 and transforming to its translucent or at least semi-transparent state. According to some embodiments, the melted first yarn 201 may fuse at least partially to the surrounding and adjacent knit loops of the second yarn 202 and/or cover the second yarn 202 along the first surface 131 and/or the second surface 132. In one example, the fusing of the first yarn 201 may serve as a "glue" to hold the adjacent knit loops and/or knit courses formed by the second yarn 202 together to enhance the strength and structural characteristics of the knitted component 140. In other words, one or more of the fused areas formed by melting the first yarn 201 to the second yarn 202 may provide additional advantageous characteristics to the upper, including, but not limited to increased water resistance, durability, stability, structure and lock-out.

Following the heating process, the transition region 230 may provide a visually attractive aesthetic characteristic. In one example, as the second yarn 202 from the surrounding region 220 extends into the transition region 230 and terminates at or before reaching the window region 210. Because the second yarn 202 does not melt during the heating process and generally retains its knit structure (a series of knit loops of the second yarn 202), the second yarn 202 may appear to be floating within the now-translucent, or at least semi-transparent portion of the melted first yarn 201 following the heating process. In particular, the individual knit loops formed by the second yarn 202 within the transition region 230 appear to be floating amongst the surrounding melted first yarn 201 in the transition region 230. In one non-limiting example, the "floating loops" may be seen through a clear finish (such as a translucent or at least semi-transparent) if a release paper (e.g. a Teflon® paper) is used during the heat press process as described below or, alternatively, through a relatively matte finish if silicon pads are used during the heat press process.

Advantageously, the knitted component 140, having one or more fused areas 126, may provide an article of footwear 100 with both the desired features that result from melting the first yarn 201 (e.g., water repellence, water resistance, water-proofing, desirable visual aesthetics, and durability) while simultaneously providing advantages associated with the second yarn 202 including, but not limited to, comfort, moisture wicking, soft hand and elasticity.

Figure 6:
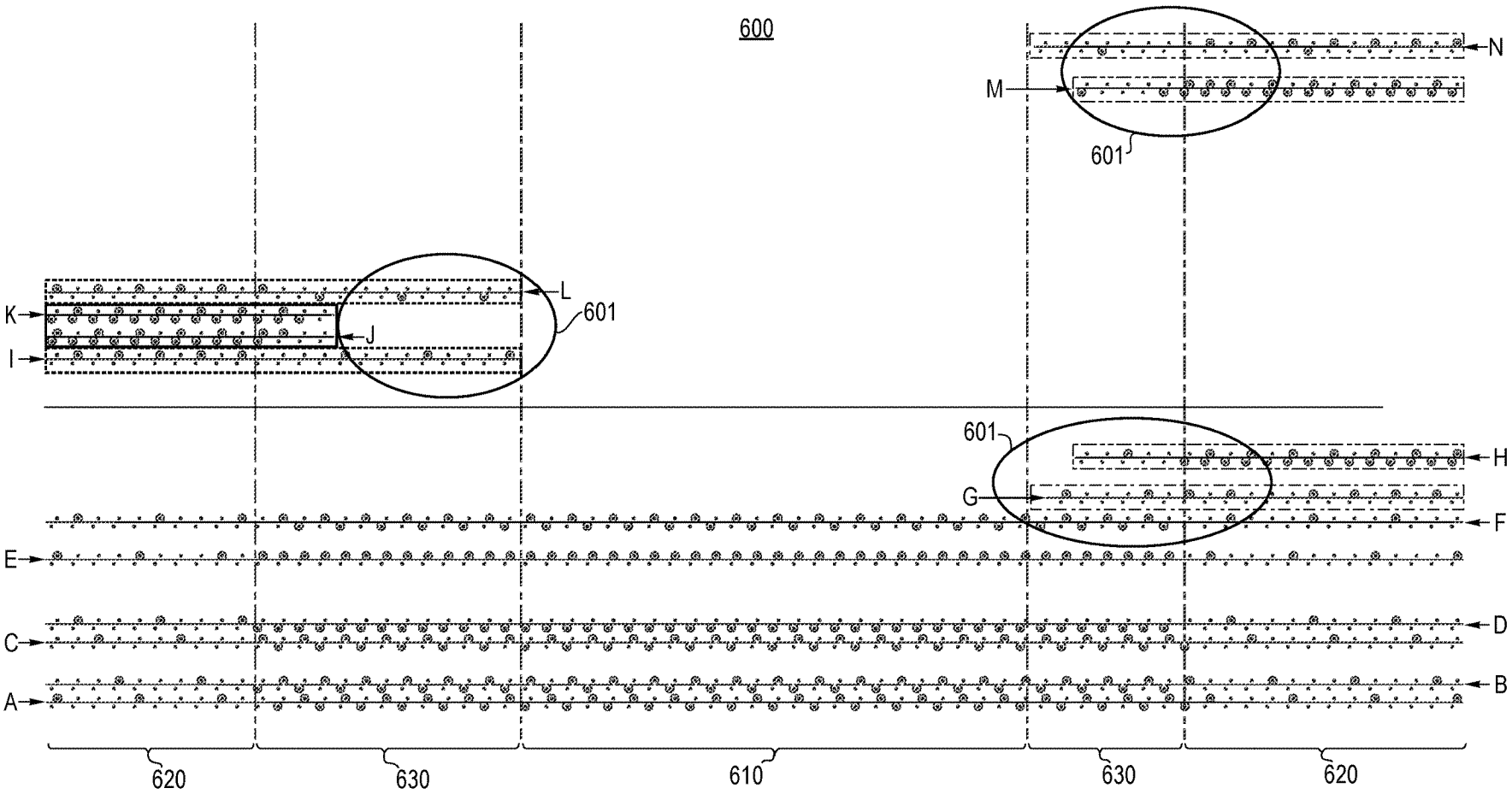
FIG. 6 shows an example of a knit diagram for knitting at least a portion of a knitted component in accordance with certain embodiments of this disclosure.

When forming the knitted component 140 on a knitting machine, any suitable knitting sequence may be used. One knitting sequence that has been found to be suitable for knitting the window region 210 shown in FIG. 3 is illustrated in the knit diagram 600 in FIG. 6. While FIG. 6 represents one possible knitting sequence, it will be appreciated that other knitting sequences may be used, including the use of different yarns and/or different knitting techniques to form one or more fused areas or window regions. Instances of the "floating" second yarn 202 are represented by specific knitting sequences 601 in the knit diagram 600, as explained in more detail below.

Referring to FIG. 6, the first pass of a feeder in a series of knitting passes may be represented by row A, a second pass of a feeder may be represented by row B, a third pass of a feeder may be represented by row C, a fourth pass of a feeder may be represented by row D, a fifth pass of a feeder may be represented by row E, and a sixth pass of a feeder may be represented by row F. In one example, rows A-F are knit using the first yarn 201 (e.g. "N110").

The first pass of the feeder represented by row A includes knitting the first yarn 201 on a back bed of a knitting machine at predetermined needles within a surrounding region 620. For example, to form the surrounding region 620 (corresponding to surrounding region 220 in FIGS. 2-5), the first yarn 201 is knit on every fourth (or fifth, or other predetermined number) needle of the back bed. Then, to knit transition region 630 (corresponding to transition region 230 in FIGS. 2-5) the first yarn 201 alternates between the back bed and a front bed (e.g., interlocking knit structure). As the feeder continues the first pass, the first yarn 201 continues to form the interlocking knit structure by alternating between the back bed and the front bed within a window region 610 (corresponding to window region 210 in FIGS. 2-5). As the feeder further continues, the first yarn 201 continues to alternate between the front and back beds to again form transition region 630, and then back to knitting on every fourth (or fifth, or other predetermined number) needle of the back bed to again form the surrounding region 620 at the end of row A of the first pass.

Next, the second pass of the feeder represented by row B includes knitting the first yarn 201 at predetermined intervals on needles of the back bed within the surrounding region 620. For example, to form the surrounding region 620, the first yarn 201 may be knit on every fourth (or fifth, or other predetermined number) needle of the back bed, while floating the needles in between. As the feeder moves to the transition region 630, then to the window region 610 and back to the transition region 630, the first yarn 201 is alternatingly tucked between the front and back beds. Then, at the end of the second pass of the feeder in row B, the first yarn 201 is again knit on every fourth (or fifth, or other predetermined number) needle of the back bed to form the surrounding region 620.

Next, the third pass of the feeder represented by row C includes knitting the first yarn 201 at predetermined intervals on needles of the back bed within the surrounding region 620. For example, to form the surrounding region 620, the first yarn 201 may be knit on every fourth (or fifth, or other predetermined number) needle of the back bed, while floating the needles in between. As the feeder moves to the transition region 630, then to the window region 610 and back to the transition region 630, the first yarn 201 is alternatingly tucked between the front and back beds. Then, at the end of the second pass of the feeder in Row B, the first yarn 201 is again knit on every fourth (or fifth, or other predetermined number) needle of the back bed to form the surrounding region 620.

Next, the fourth pass of the feeder represented by row D includes knitting the first yarn 201 on needles of the back bed at predetermined intervals within the surrounding region 620. For example, the first yarn 201 is knit on every fourth (or fifth, or other predetermined number) needle of the back bed (e.g., floating four needles in between) to form the surrounding region 620. As the feeder continues the pass to form the transition region 630, the window region 610 and again the transition region 630, the first yarn 201 is knit on every needle of the front bed. As the feeder continues the pass to again form the surrounding region 620, the first yarn is knit on every fourth (or fifth, or other predetermined number) needle of the back bed.

Next, the fifth pass of the feeder represented by row E includes knitting the first yarn 201 on the back bed on needles at predetermined intervals within the surrounding region 620. For example, the first yarn 201 is knit on every fourth (or fifth, or other predetermined number) needle (e.g., floating four needles in between) to form the surrounding region 620. As the feeder continues the pass to form the transition region 630, the window region 610 and again the transition region 630, the first yarn 201 is knit on every needle of the back bed. As the feeder continues the pass to again form the surrounding region 620, the first yarn is knit on every fourth (or fifth, or other predetermined number) needle of the back bed.

Next, the sixth pass of the feeder represented by row F may be a substantial repeat of row A, and includes knitting the first yarn 201 on a back bed at predetermined needles within a surrounding region 620. For example, to form the surrounding region 620, the first yarn 201 is knit on every fourth (or fifth, or other predetermined number) needle of the back bed. Then, to knit transition region 630 the first yarn 201 alternates between the back bed and a front bed (e.g., interlocking knit structure). As the feeder continues the first pass, the first yarn 201 continues to form the interlocking knit structure by alternating between the back bed and the front bed within a window region 610. As the feeder further continues, the first yarn 201 continues to alternate between the front and back beds to again form transition region 630, and then back to knitting on every fourth (or fifth, or other predetermined number) needle of the back bed to again form the surrounding region 620 at the end of the sixth pass.

Next, rows G-N of the knit diagram 600 in FIG. 6 are knit with the second yarn 202. The second yarn 202 may be one color or may be multiple colors. The knit diagram illustrates rows G-N in different colors (or different shades of black and white/grayscale) to represent different feeders, but each of the different feeders are dispensing the second yarn 202.

Rows G-N generally illustrate the second yarn 202 extending from the surrounding region 620, within and through the transition region 630, and terminating before or at the window region 610. In one example, it can be seen that in row G, the second yarn 202 is knit at various intervals on needles of the back bed, while in row H, the second yarn 202 is knit at various intervals on needles of both the front and the back bed. Row I shows the second yarn 202 being knit at various intervals on needles of the back bed, while rows J and K illustrate the second yarn being alternatingly knit on every needle between the front and back bed. Rows L, M an N illustrate the second yarn 202 being knit at various intervals between the front and back beds.

As such, rows G-N represent the second yarn 202 extending from the surrounding region 620 through the transition region 630, resulting in the visual effect described above. In other words, in the transition region 630, the structure of the second yarn 202 is generally maintained to appear as though the knit loops of the second yarn 202 are suspended in, or floating, within a fused area 126 formed by the first yarn 201 in the transition region 630 after the knitted component 140 is exposed to a heating process.

Where the second yarn 202 is knit on the front bed, it may appear closer to one surface of the upper and when the second yarn 202 is knit on the back bed, it may appear closer to a second opposite surface of the upper 120, similar to that mentioned above with respect to areas 240, 250. Thus, in some embodiments, when the second yarn 202 is knit on the front bed, the second yarn 202 may appear to be closer to the first (outer) surface 131 of the translucent or semi-transparent fused area 126 formed by the first yarn 201. Conversely, when the second yarn 202 is knit on the back bed, the second yarn 202 may appear to be closer to the second (inner) surface 132 of the translucent or semi-transparent fused area 126 formed by the first yarn 201.

Alternating the first yarn 201 and the second yarn 202 between the back bed and the front bed during the knitting process, and utilizing the different knit structures, provide several advantages. These advantages include, for example, the ability to provide a tight, non-porous structure in one or more of the fused areas 126, including the window region 610, the ability to vary visual effects such as the appearance of the knit loops of the second yarn 202 floating or suspended within the transition region 630, the ability to control the elasticity of the knitted component 140, the ability to control the density of the knitted component 140, the ability to control the thickness of the knitted component 140, and/or the ability to control the durability, water repellency and/or softness and other surface characteristics of the first surface 131 and/or the second surface 132.

In some embodiments, the amount and/or the density of the fused and/or non-fused thermoplastic polymer material present in different regions of the knitted component 140 may vary. Hereinafter, the term "density" when referring to a fused area 126 refers to the amount (i.e., mass) of fused material (e.g., fused thermoplastic polymer material) per a determined surface area.

It is also contemplated that instead of (or in addition to) varying the amount of the thermoplastic polymer (e.g., first yarn 201) at different areas of the knitted component 140, different areas of the knitted component 140 having the thermoplastic polymer may be processed differently (e.g., more heat and/or pressure may be administered in areas having a greater amount of the first yarn 201 during a heat-pressing process). In some embodiments, some selected areas of the knitted component 140 having the thermoplastic polymer may not form a fused area 126 at all. For example, while the knitted component 140 may comprise the first yarn 201 in certain areas where a fused area 126 is not desired, there may be no additional processing (e.g. heat processing or the like) that would result in the formation of a fused area 126 in those areas.

Referring to FIGS. 7A-D, in one non-limiting example, a heating process such as a heat-pressing process may be performed to form a fused area 126 from a thermoplastic polymer material knitted into the knitted component 140. More particularly, a thermoplastic polymer material may be incorporated into the knitted component 140 by knitting with above-described first yarn 201 having the thermoplastic polymer material.

FIGS. 7A-7D generally depict a heat press 760 and associated components. The heat press 760 may include a top plate 762 and a bottom plate 764. Each of these plates has a surface that may or may not provide heat and may or may not contact a side of the upper 720. The materials used to form the plates are not limited. In some aspects, the plates may include a metal and/or silicone or combination thereof. In some embodiments, the bottom plate 764 may be formed of silicone and the top plate 762 may be formed of a metal.

In some embodiments, an upper 720 may be disposed on the bottom plate 764, and the top plate 762 may be lowered until a surface thereof contacts the upper 720. An amount of pressure may be applied by the top plate for a pre-selected amount of time, and since the bottom plate is stationary, the upper 720 is at least partially compressed in one or more selected areas. In some aspects, after the top plate 762 is lowered to contact the upper 720, the top plate and the bottom plate remain separated and do not contact each other. The heat press may comprise a stopper (not shown) to prevent the top plate 762 and bottom plate 764 from making contact with each other.

Figure 7B:
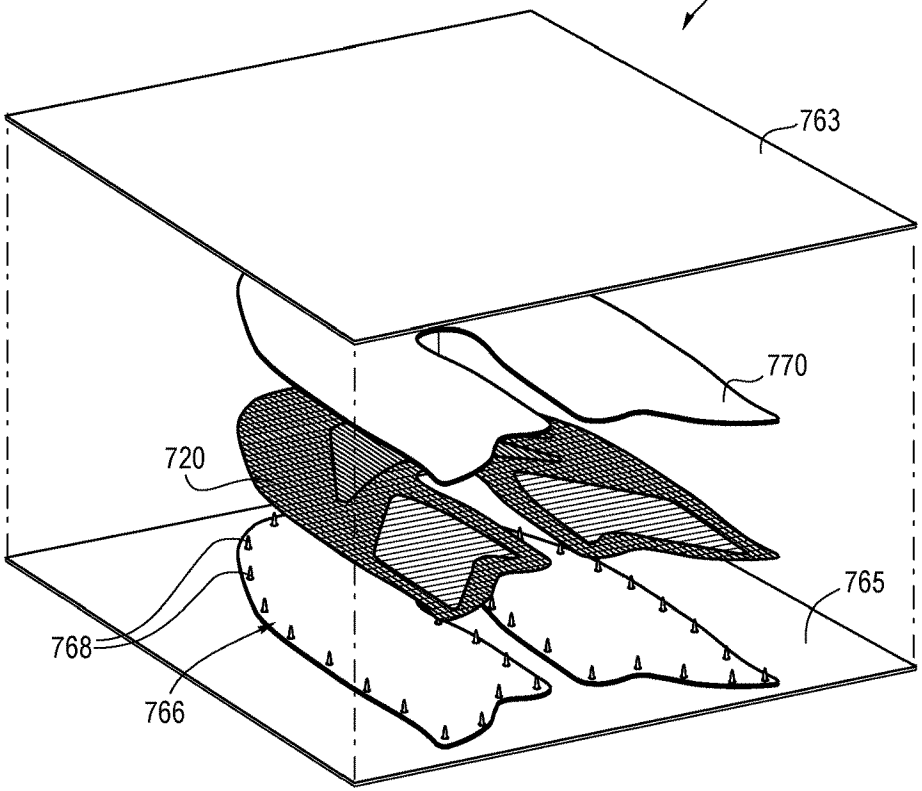
FIG. 7B shows an example of a heat press and related components used in one process of forming an upper with at least one fused area in accordance with certain embodiments of this disclosure.
Figure 7A:
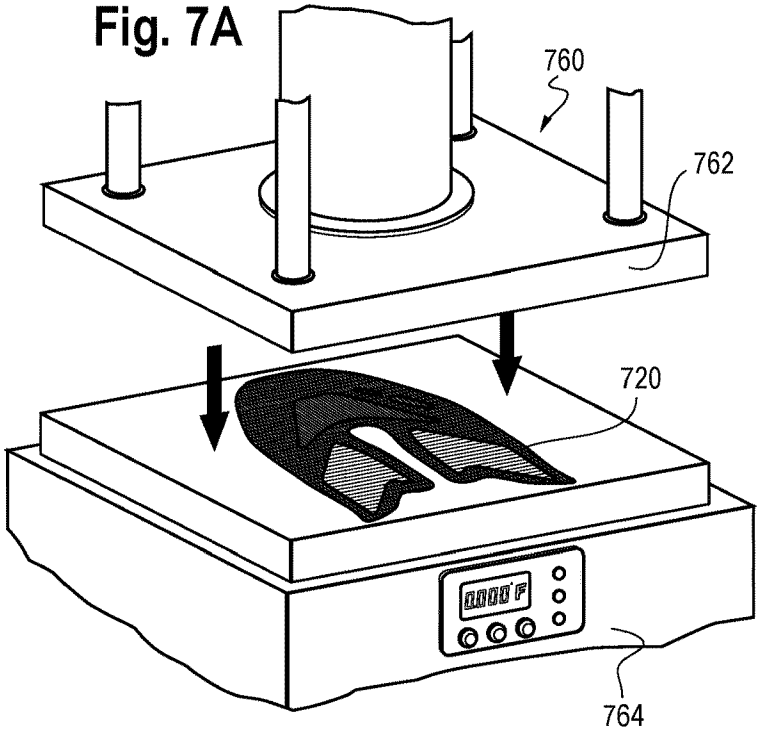
FIG. 7A shows an example of a heat press and related components used in one process of forming an upper with at least one fused area in accordance with certain embodiments of this disclosure.

As shown in FIG. 7B, a jig 766 may be used to hold and/or position the upper 720 during the heat pressing process. The jig 766 may be a separate element from the heat press 760, or the jig 766 may be disposed on the bottom plate 764 of the heat press 760. The jig 766 may have a top section 763 and a bottom section 765, which may be formed using any material, such as rubber or metal. If the material used to form the jig 766 has a melting temperature, the melting temperature should be above the typical temperature achieved during the heat-pressing process to ensure that the heat-pressing process does not disfigure, alter, damage or otherwise negatively affect the jig 766. The shape and configuration of the jig 766 is also not limited. In FIG. 7B, the shape of the jig 766 is generally rectangular. The jig 766 may include a positioning device, in this case a plurality of spring-loaded pins 768 that is configured to position the upper 720. Here, the shape of the plurality of spring-loaded pins 768 is substantially the same as the shape of an upper 720 such that it corresponds with the outer perimeter of the upper 720. The upper 720 may include a plurality of apertures configured to receive the spring-loaded pins 768, and/or the spring-loaded pins may penetrate through the upper 720 to hold the upper 720 in position upon and within the jig 766.

The jig 766 may further include a pad (not shown) configured to prevent the upper 720 from sticking to the heat press 760. The pad may provide insulation and/or provide cooling, particularly when the desired fused area (e.g., fused area 126 of FIG. 1) is located only on one side or one surface of the upper 720. The pad may generally be in the shape of the desired fused area of the upper 720. The thickness of the pad may reduce the amount of heat applied and even reduce or substantially prevent the areas of the upper 720 not corresponding to a fused area (e.g., the throat area) from being pressed, directly heated and/or burned. In one embodiment, the pad is formed of Teflon and is approximately 5 mm thick, though any suitable thickness may be used. The spring-loaded pins 768 are configured to compress if necessary during the heat-pressing process such that they do not inhibit the pressure applied to the upper 720 (e.g., if the spring-loaded pins 768 are longer than the thickness of the upper 720). In some embodiments, the jig 766 may be configured such that two or more uppers 720 can be processed simultaneously.

A release paper 770 may be placed over the areas corresponding to the fused area(s) 126 of the upper 720, as shown. The release paper is preferably constructed of a material that reduces or prevents the fused area(s) 126 of the upper from sticking to it and therefore, the release paper 770 may also prevent the fused area of the upper 720 from sticking to the jig 766. The release paper 770 may be configured to allow heat to be conducted to the upper 720 directly through the release paper 770 and without interfering in the heating process.

Figure 7D:
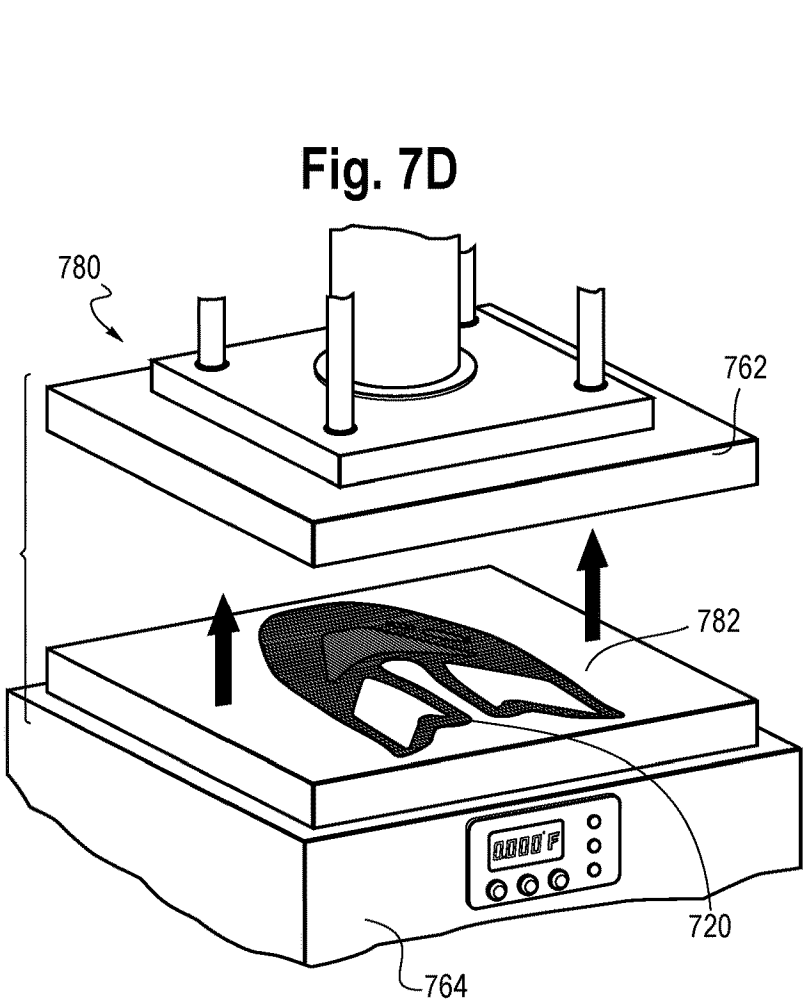
FIG. 7D shows an example of a cold press and related components used in one process of forming an upper with at least one fused area in accordance with certain embodiments of this disclosure.
Figure 7C:
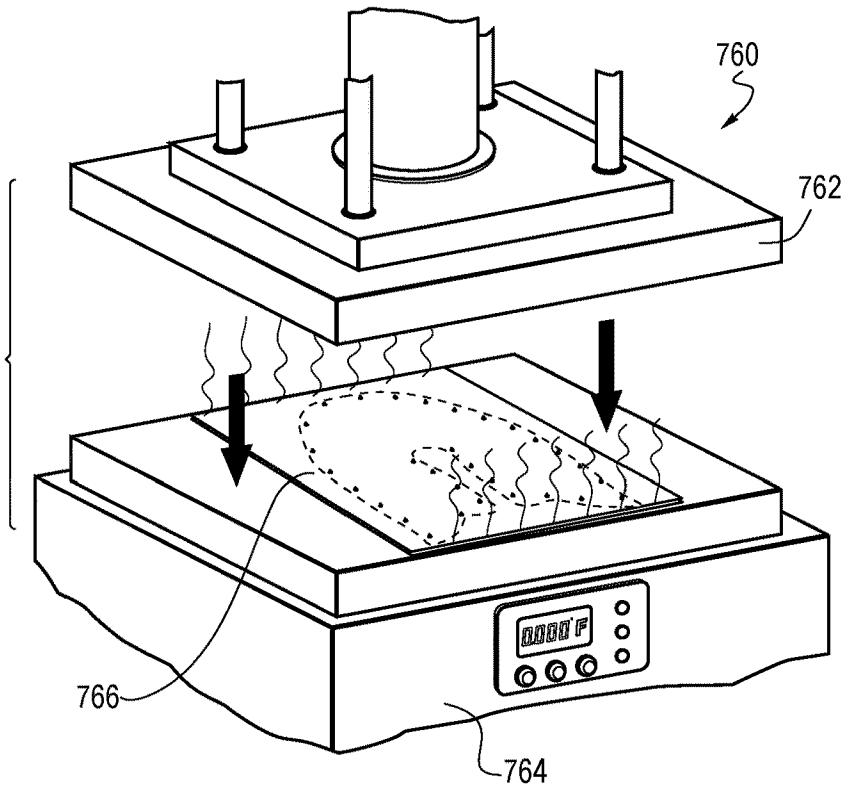
FIG. 7C shows an example of a heat press and related components used in one process of forming an upper with at least one fused area in accordance with certain embodiments of this disclosure.

Next, referring to FIG. 7C, the jig 766 may be closed and placed into the heat press 760. The heat press 760 may be preheated to between about 100° C. and about 150° C. (or any other suitable temperature range). The press may then be activated. In one embodiment, the heat press may apply approximately 40 kgf of pressure at between about 140° C. and about 160° C. for a period of 40-45 seconds. When subjected to this heat and pressure, the thermoplastic polymer material of the upper 720, such as the thermoplastic polymer material included with a yarn (i.e., the first yarn 201 described above), may at least partially melt. As a result, the material originally forming separate yarns of the upper 720 may become bonded and/or continuous to form a fused area. Therefore, any one or more areas where the upper 720 contains thermoplastic polymer material, and where that material is subjected to a suitable process (such as the heat-pressing process described herein), it is contemplated that a fused area 126 will be formed. A thermocouple (not shown) may measure the temperature of the upper 720 during this process. Once the upper 720 reaches a predetermined temperature (e.g., between about 120° C. and about 132° C.), the heat press 760 may open, and the upper 720 may be removed. While a heat-pressing process is described, any other suitable process may be used to form the fused areas, including subjecting the upper to a steaming process.

Next, the heated upper 720 may go through a cooling process, such as a cold-pressing process. The cooling process may set the fused area 126 of the upper 720 or otherwise bring the fused area 126 into a state other than a melted state. Referring to FIG. 7D, the upper 720 may be placed in a cold press 780. A silicon pad 782 (which may be any other suitable material) may be placed on one or both sides of the upper 720, and particularly over the heated and/or partially melted areas, to ensure even pressure. The cold press 780 may include a refrigeration system, but in some embodiments the cold press 780 is at or about at room temperature. When activated, in one non-limiting example, the cold press 780 may apply approximately 20 kgf of pressure for about 30 seconds. During the cold-pressing process, the release paper 770 may remain attached to the upper 720 to prevent the upper 720 from sticking to the cold press 780, though this is not required. Further, while shown without the use of a jig, the cold press 780 can be used in conjunction with a jig similar to the jig 766 described with respect to the heat-pressing process. The use of the silicon pad 782 may be used to achieve a matte finish to the melted first yarn 201. The use of a release paper or another material such as Teflon paper in place of the silicon pad 782 may be used to achieve a smooth and/or clear finish to the melted first yarn 201. It follows that the surface texture of the fused area resulting from the melted first yarn 201 may take on the surface properties of a pressing part used during the heat-pressing process.

Visually, threads of the melted first yarn 201 in the window region 210 may be at least partially and/or substantially visually indistinguishable from each other as they would have melted with each other during the heating process. The once-separate individual knit loops of the first yarn 201 in the window region 210, after melting, may become at least partially and/or visually indistinguishable from a distance of about several inches to several feet away to a person having standard or normal vision. However, it is appreciated that a person with better vision may be able to distinguish certain properties of the melted first yarn 201 in the window region 210 (e.g., such as the once-separate yarns having become at least partially and/or substantially visually or physically indistinguishable, or both after melting as well as the texture of the surface in the fused area) from these same distances or even greater distances.

The surface texture of the melted first yarn 201 in the window region 210 may be different from the surface texture of the knitted yarns in the surrounding region 220 and/or the transition region 230, as the surrounding region 220 and/or the transition region 230 still includes the second yarn 202 that have not melted. For example, the second yarn 202 may provide a textured surface in the surrounding region 220 and/or the transition region 230, while the melted first yarn 201 in the window area 210 is characterized by a smooth film-like surface when a smooth release paper is used during the heat pressing process. In another example, if a release paper having a particular texture is used (such as a faux-leather texture, dimpled texture or other texture) then the melted first yarn 201 in the window area 210 may have a different texture than the knitted yarns in the surrounding region 220 and/or the transition region 230.

In some embodiments, a heat pressing process may be used to attach an auxiliary component to the upper 720. While not shown, the auxiliary component, which may include a thermoplastic polymer material, may be placed in contact with the upper 720 such that it at least partially melts and thereby adheres to the upper 720 during the heat-pressing process. Alternatively, or in addition, an auxiliary component may be substantially free of a thermoplastic polymer and may be bonded to the upper 720 by placing the auxiliary component in contact with the heated thermoplastic polymer of the upper 720. This may be done in conjunction with the process of forming the fused areas 126 (see FIG. 1) or may be done at a different time.

All of the structures and methods disclosed and claimed herein can be made and executed without undue experimentation in light of the present disclosure. While this disclosure may be embodied in many different forms, there are described in detail herein specific aspects of the disclosure. The present disclosure is an exemplification of the principles of the disclosure and is not intended to limit the disclosure to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the disclosure and without diminishing its intended advantages. It is therefore intended that such changes and modifications be covered by the appended claims.

We claim:

1. A knitted component comprising:

a window region formed entirely of a first yarn fused together, the first yarn formed entirely of a thermoplastic material and having a first melting temperature;

a first region comprising the first yarn and a second yarn that has a second melting temperature that is higher than the first melting temperature, wherein the first region comprises a greater percentage by unit area of the second yarn than the first yarn, and wherein the first region encircles the window region; and a transition region located between the first region and the window region, and wherein, on at least a first side of the window region, the transition region comprises a plurality of courses of loops of the second yarn and comprises fused courses of the first yarn, each course of the plurality of courses of loops of the second yarn is separated from adjacent courses of loops of the second yarn within the transition region by fused courses of the first yarn in the transition region, wherein in the transition region on the first side of the window region, each course within the plurality of courses of loops of the second yarn extends from the first region to the window region and terminates at the window region.

2. The knitted component of claim 1, wherein the first melting temperature is less than 200 degrees Celsius, and wherein the second yarn comprises a polyester material having the second melting temperature that is greater than the first melting temperature.

3. The knitted component of claim 2, wherein the first melting temperature is between about 100 and about 150 degrees Celsius.

4. The knitted component of claim 1, wherein the second yarn is a polyester yarn.

5. The knitted component of claim 1, wherein the second yarn is a non-plastic yarn.

6. A textile comprising:

a first region comprising a first thermoplastic material and a second yarn, wherein the first thermoplastic material is at least partially fused to one or more knit loops of the second yarn;

a window formed entirely of the first thermoplastic material fused together, wherein the window is at least semi-transparent and is encircled by the first region; and a transition region formed of the first thermoplastic material and the second yarn, the transition region being located between the first region and the window, wherein on at least a first side of the window, the transition region comprises a plurality of courses of loops of the second yarn and comprises fused courses of the first thermoplastic polymer material, each course of the plurality of courses of loops of the second yarn is separated from adjacent courses of loops of the second yarn within the transition region by fused courses of the first thermoplastic material within the transition region, wherein in the transition region on the first side of the window, each course within the plurality of courses of loops of the second yarn from the first region extends from the first region to the window and terminates at the window.

7. The textile of claim 6, wherein the transition region extends on a second side of the window between the window and the first region.

8. The textile of claim 6 wherein one or more knit loops of the second yarn maintain their knit loop structure in the transition region.

9. An article of footwear comprising an upper at least partially formed with the textile of claim 6.

10. The article of footwear of claim 9, wherein the first region comprises a portion of the textile positioned between a biteline of the article of footwear and the window and also comprises a portion of the textile between the window and a throat of the article of footwear.

11. The article of footwear of claim 9, wherein the window extends between a lateral side and a medial side of the upper in a forefoot region.

* * * * *